US006604481B2

(12) United States Patent
Johnston

(10) Patent No.: US 6,604,481 B2
(45) Date of Patent: Aug. 12, 2003

(54) METHOD AND APPARATUS FOR PERMITTING PASSAGE OF CONDUITS THROUGH HULL OF BOAT

(76) Inventor: Charles E. Johnston, 3927 Road 6.5 NE., Moses Lake, WA (US) 98837

( * ) Notice: Subject to any disclaimer, the term of this patent is extended or adjusted under 35 U.S.C. 154(b) by 0 days.

(21) Appl. No.: 10/035,776

(22) Filed: Dec. 24, 2001

(65) Prior Publication Data

US 2003/0116073 A1 Jun. 26, 2003

(51) Int. Cl.[7] ..... B63B 13/00
(52) U.S. Cl. ..... 114/183 R; 114/197
(58) Field of Search ..... 114/182, 183 R, 114/184, 197, 198; 137/513.7

(56) References Cited

U.S. PATENT DOCUMENTS 1,463,103 A * 7/1923 Thorsten ..... 137/527.8
1,669,276 A * 5/1928 Baldwin ..... 114/185
1,800,556 A * 4/1931 Mead ..... 114/182
2,532,067 A * 11/1950 La Bour ..... 137/515.5
3,565,107 A * 2/1971 Bunch ..... 137/515.7
4,516,515 A * 5/1985 Johnson ..... 114/197
5,176,097 A * 1/1993 Bonin et al. ..... 114/183 R
5,385,108 A * 1/1995 Thompson ..... 114/183 R
6,050,867 A * 4/2000 Shields et al. ..... 440/88

* cited by examiner

*Primary Examiner*—S. Joseph Morano
*Assistant Examiner*—Ajay Vasudeva
(74) *Attorney, Agent, or Firm*—Birch, Stewart, Kolasch & Birch, LLP

(57) ABSTRACT

A method and apparatus is disclosed for permitting the passage of conduits through the hull of a boat without the creation of additional holes. A conduit-accommodating passageway is defined through the boat's scupper which bypasses the check valve that is associated with the scupper to prevent backflow. An annular body having a radially-extending conduit-accommodating passage communicating between its O.D. and its I.D. is positioned with respect to the scupper so that the fluid passing through the scupper and check valve passes through the generally annular body's I.D. while conduit passing through the radially-extending passage passes through the scupper but bypasses the check valve.

16 Claims, 3 Drawing Sheets

METHOD AND APPARATUS FOR PERMITTING PASSAGE OF CONDUITS THROUGH HULL OF BOAT

BACKGROUND

This invention relates to a method and apparatus for permitting mechanical and electrical connections to be made between the interior and exterior of a boat without breaching the hull.

It is frequently necessary to couple sensors positioned on a boat's exterior to instruments or mechanisms located on the boat's control panel, within the boat's cockpit or elsewhere within the boat's interior. Such sensors include, but are not limited to, sonar, speed and temperature sensors, and are typically mounted on the exterior of the hull. The connection of the sensors to the instrumentation has conventionally required holes to be created in the hull, through which electrical wire or cables can be passed to the boat's interior. Each hole formed in the hull, however, creates a potential leakage path. This is particularly true where the hole is not made as part of the manufacturing process, wherein special tools and skills are employed. In particular, holes made by boat owners in the course of adding equipment to their boats are particularly prone to leakage, and other complications can arise as well where the boat has a double-walled hull in the area where the hole is to be made.

SUMMARY OF THE INVENTION

The invention herein is directed to a method and apparatus for permitting the passage of conduits through the hull of a boat without the creation of additional holes. The term "conduits" will be understood to include, but not be limited to, pneumatic, hydraulic, electrical and mechanical links. Briefly, use is made of the boat's scupper. The invention herein provides a method and means providing a conduit-accommodating passageway without breaching the hull by providing a passageway through the scupper which bypasses the check valve. A preferred embodiment of the invention is described in the following Description of the Preferred Embodiment, of which the drawing forms a part.

THE DRAWING

DESCRIPTION OF THE PREFERRED EMBODIMENT

A scupper is a drainage conduit having an inlet opening that is typically at deck level, and an outlet opening that extends through the ship's hull. Any water which accumulates on the deck can accordingly drain out of the ship via the scupper.

Figure 1:
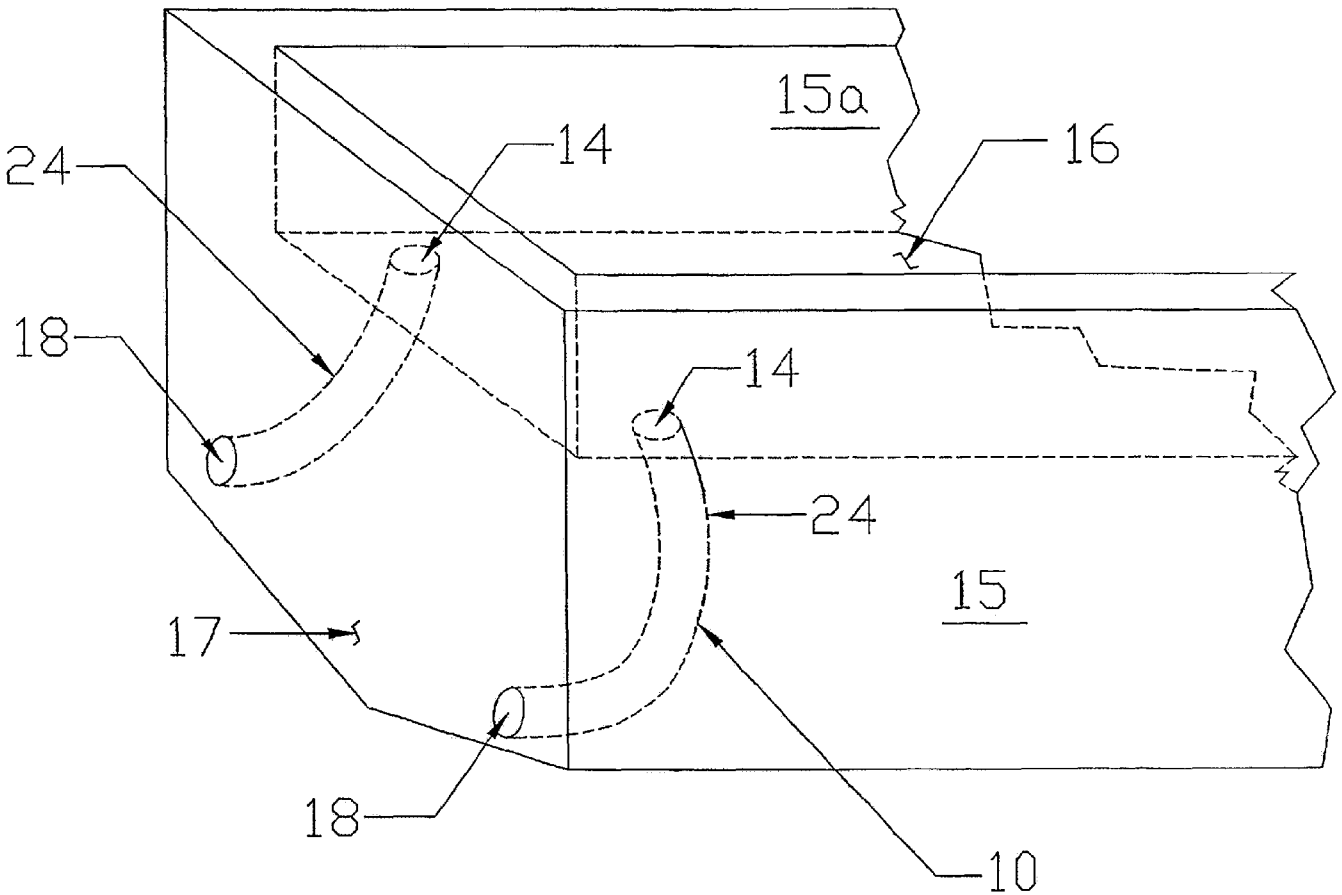
PRIOR ART FIGURE 1
FIG. 1 is a side elevation view in schematic of a conventional scupper known in the art.

The first scuppers were merely holes formed in the hull at deck level which permitted water to drain off the deck and out of the boat. A typical contemporary scupper is illustrated in FIG. 1 as comprising a scupper conduit 10 extending from an inlet end 14 in fluid communication with the deck 16 to an outlet end 18. The inlet end 14 may be covered by a protective mesh or grating that is mounted flush with the deck to reduce the risk of small objects on the deck being lost via the scupper. FIG. 1 illustrates a pair of scuppers respectively passing through the port and starboard regions of the boat's transom, but those skilled in the art will recognize that the location and number of scuppers is not limited to those shown in the Figure.

Figure 2:
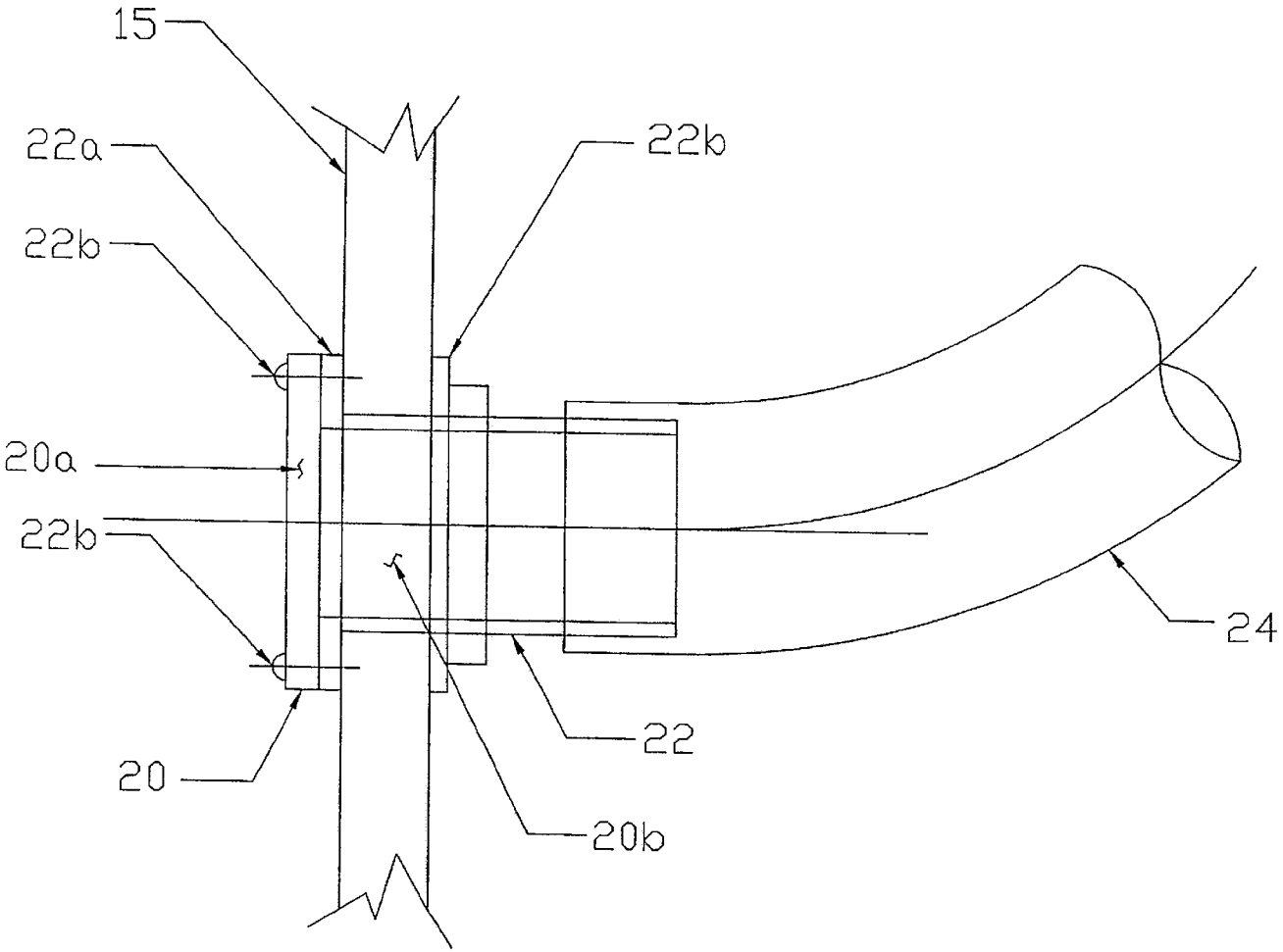
PRIOR ART FIGURE 2
FIG. 2 is a side elevation view in schematic of a conventional check valve arrangement used with scuppers.

To prevent the backflow of water through the scupper and onto the deck, scuppers typically have a check valve located at the outlet end. In FIG. 2, a check valve 20 is illustrated in a conventionally position at the outlet end of the scupper. The depicted check valve utilizes a swinging flap, movable plug or the like, which is pushed away from the scupper's outlet by water flowing outward from the deck, thereby permitting water to be discharged through the hull. Water attempting to back-flow into the discharge end of the scupper, however, presses the flap, plug, etc. into a sealing position that prevents the water from passing through the valve and into the scupper. Many types of check valve elements are used for scupper closure, such as "duck bill", flap and ball-type elements, and the invention herein is not limited to any particular type of check valve.

The scupper in FIG. 2 accordingly comprises a generally annular thru-hull fitting 22 that passes through the hull via a hole formed in the hull below deck level for that purpose. The fitting 22 has an exterior flange 22*a* which makes contact with the exterior region of the hull surface that circumscribes the hole. The fitting 22 extends through the hull into a scupper conduit 24 that conducts the water from the deck to the fitting. The flange 22*a* is sealed to that circumscribing region with silicone or other known sealant, and secured in place with a large nut 22*b* that threads onto the interior end of the thru-hull fitting and is tightened against the interior surface of the hull.

The check valve 20 typically includes a flanged body 20*a* that is secured to the scupper flange 22*a* with screws 22*b* that respectively extend into internally threaded holes in the scupper flange 22*a*. The check valve flange 20*a* can be sealed to the scupper flange 22*a* with silicone or other known sealant. The check valve flange body 20*a* circumscribes a fluid-conducting passage 20*b*. Water traveling down the conduit 24 pushes the flap (or other movable check valve element) open and is discharged through the passage 20*b*, while water attempting to backflow into the passage 20*b* from outside the boat pushes the flap (or other element) closed.

Figure 3:
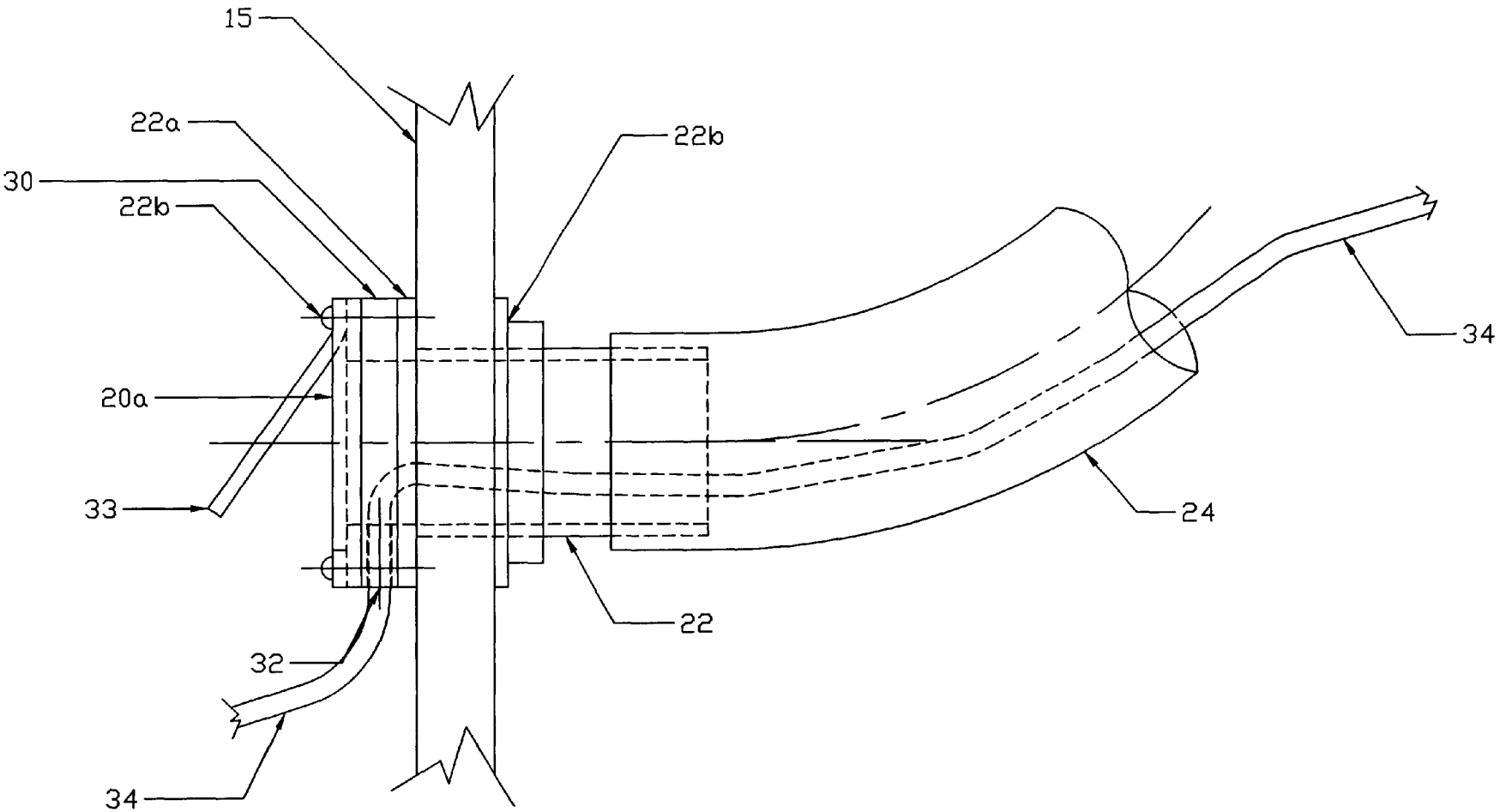
FIG. 3 is side elevation view of apparatus constructed in accordance with the invention for permitting mechanical and/or electrical connections to be made between the interior and exterior of a boat without breaching the hull.

FIG. 3 is side elevation view of apparatus constructed in accordance with the invention for permitting mechanical and/or electrical connections to be made between the interior and exterior of a boat without breaching the hull. In FIG. 3, a annular conduit-passage ring 30 is positioned between the scupper flange 22*a* and the check valve body 20*a*. The conduit ring is sized to sealingly engage the scupper and check valve flanges, with its internal diameter ("I.D.) generally concentric with those of the two flanges. The ring 30 includes a radially extending passage 32 that communicates between the exterior and interior of the ring, to permit the passage of a conduit or cable from the ship's exterior to enter the scupper conduit 24 while bypassing the check valve 20. Following the scupper conduit, the cable or conduit from the exterior of the ship can enter the deck area. Those skilled in the art will recognize that an additional ring 30 can be utilized at the deck level if another check valve is located at the inlet end of the scupper in order to bypass that valve as well. Thus, electrical and mechanical connections can be made linking equipment within the ship to equipment on the ship's hull without breaching the hull or interfering with the scupper's check valve operation.

The ring 30 is preferably formed from UHMW or polyethylene plastic, aluminum, or other material which is inert in fresh water and sea water. Its dimensions depend on the size of the scupper flange and accommodated cable; in practice, for example, a ½-inch thick ring has been used to accommodate a 5/16-inch electrical cable.

Preferably, the radially-extending passage 32 is internally threaded to mate with an externally threaded cable fitting that is sealed about the cable with silicone or other sealant. Any leakage around the threads will be so minimal that normal scupper operation will be unaffected, but the threads can be sized and shaped to provide a substantially watertight, compression fit or other sealing means can be employed to prevent water from leaking around the threads and into the scupper if desired.

It should be recognized that the ring 30 depicted in FIG. 3 is intended to provide a relatively easy retrofit which an average boat owner can employ. Alternatively, the flange of the scupper fitting, such as flange 22*a* illustrated in FIG. 2, or the body of the check valve can be modified to include a radially-extending, cable-accommodating passage which enable a cable or conduit to bypass the check-valve's movable member while passing through the hull via the scupper.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. For use with a boat having a deck, a hull generally circumscribing the deck;

at least one scupper having an inlet positioned to accept the ingress of liquid from the deck, an outlet for discharging said liquid to the exterior of the boat, a conduit for carrying the liquid from the inlet to the outlet, and a check valve for permitting the carried liquid to flow in substantially one direction only, a conduit-passage ring for permitting mechanical and electrical connections to be made between the interior and exterior of the hull without breaching the hull and comprising:

a generally annular body having a radially-extending, cable-accommodating passage communicating between its OD and its ID, said generally annular body being positioned with respect to the scupper so that the fluid passing through the scupper conduit passes through the generally annular body's ID while cable passing through the radially-extending passage bypasses the check valve.

2. The conduit passage ring of claim 1 wherein the check valve includes a generally annular flange mounted to the hull adjacent the scupper outlet and circumscribing a fluid-conducting passage that is generally aligned with the scupper conduit to conduct the carried fluid, and a displacable member positioned within the check valve passage, said displacable member being mounted with respect to the passage and responsive to carried fluid flowing from the outlet towards the inlet to substantially close the passage, and being displaced from the passage by the flow of carried fluid from the inlet towards the outlet to permit such flow, and wherein said conduit passage ring is mounted between the check valve and the scupper outlet.

3. The conduit passage ring of claim 2 wherein its generally annular body is integral with the flange of the check valve.

4. The conduit passage of claim 1 wherein scupper additionally includes a fitting in the shape of a generally annular body mounted on the exterior of the hull and circumscribing the scupper outlet, and wherein the generally annular body of the conduit passage ring is integral with the generally annular body of the scupper fitting.

5. The conduit passage ring of claim 1 wherein at least portion of the radially-extending cable-accommodating passage is internally threaded.

6. The conduit passage ring of claim 5 wherein the internally threaded region of the radially-extending cable-accommodating passage is dimensioned to compressingly engage an externally-threaded, cable-circumscribing fitting to effect a substantially water-tight seal.

7. The conduit passage ring of claim 1 wherein the generally annular body is substantially formed from material selected from the group consisting of UHMW, polyethlylene plastic, aluminum, and other material which is generally chemically inert in fresh water and sea water.

8. The conduit passage ring of claim 1 wherein the check valve includes a generally annular flange mounted to the deck adjacent the scupper inlet and circumscribing a fluid-conducting passage that is generally aligned with the scupper conduit to conduct the carried fluid, and a displacable member positioned within the check valve passage, said displacable member being mounted with respect to the passage and responsive to carried fluid flowing from the outlet towards the inlet to substantially close the passage, and being displaced from the passage by the flow of carried fluid from the inlet towards the outlet to permit such flow, and wherein said conduit passage ring is mounted between the check valve and the scupper inlet.

9. The conduit passage ring of claim 8 wherein at least portion of the radially-extending cable-accommodating passage is internally threaded.

10. The conduit passage ring of claim 9 wherein the internally threaded region of the radially-extending cable-accommodating passage is dimensioned to compressingly engage an externally-threaded, cable-circumscribing fitting to effect a substantially water-tight seal.

11. The conduit passage ring of claim 1 wherein the check valve includes a generally annular flange mounted to the deck adjacent the scupper inlet and circumscribing a fluid-conducting passage that is generally aligned with the scupper conduit to conduct the carried fluid, and a displacable member positioned within the check valve passage, said displacable member being mounted with respect to the passage and responsive to carried fluid flowing from the outlet towards the inlet to substantially close the passage, and being displaced from the passage by the flow of carried fluid from the inlet towards the outlet to permit such flow, and wherein said conduit passage ring is mounted between the check valve and the scupper inlet.

12. A conduit bypass ring comprising a generally annular body formed about a central axis between interior and exterior surfaces, and adapted to be mounted between the fitting of a scupper and the body of a check valve so that the passageway circumscribed by its interior surface passes fluid from the scupper to the check valve, said annular body including a radially-extending, cable-accommodating passage communicating between its exterior and interior surfaces.

13. In combination:

a scupper having a scupper conduit extending from an inlet end adapted for fluidic communication with the deck of a ship to an outlet end adapted for fluidic communication with the region exterior to the hull of a ship, said scupper further including a flanged and generally annular fitting adapted to be sealingly mounted on the exterior of the hull in generally co-axial alignment with the scupper conduit at the scupper outlet to secure the scupper conduit to the hull at the outlet;

a check valve adapted to be mounted adjacent an end of the scupper conduit, said check valve including a flanged check valve body defining a fluid-conducting passageway, and means for permitting the substantial flow of fluid through said passageway towards the scupper outlet only, the check valve being adapted for mounting with its passageway co-axially aligned with the scupper conduit;

an annular conduit-passage ring positioned between the scupper flange and the check valve flange in general co-axial alignment therewith, the ring including a radially extending passage that communicates between the exterior and interior of the ring to permit the passage of a conduit from the hull's exterior to enter the scupper conduit while bypassing the check valve.

14. For use with a boat having a scupper and a check valve associated with the scupper to prevent backflow through the scupper, apparatus for permitting the passage of one or more conduits through the hull of a boat without the creation of additional holes comprising:

a body positioned with respect to the scupper and cooperative therewith to define a conduit-accommodating passageway through the scupper which bypasses the check valve.

15. The apparatus of claim 14 wherein said body has an annular cross-section and has a radially-extending conduit-accommodating passage communicating between its O.D. and its I.D.

16. The apparatus of claim 15 wherein said body is shaped to be substantially sealingly positioned between the scupper and check valve so that the draining fluid passing through the scupper and check valve passes through the generally annular body's I.D. while conduit passing through the radially-extending passage passes through the scupper but bypasses the check valve.

* * * * *